United States Patent [19]

Stackhouse

[11] Patent Number: 4,942,987

[45] Date of Patent: Jul. 24, 1990

[54] METHOD OF FOLDING STERILE SURGICAL GARMENTS BEFORE AND AFTER STERILIZATION

[75] Inventor: Mildred K. Stackhouse, Manhattan Beach, Calif.

[73] Assignee: Stack Holding Inc., Riverside, Calif.

[21] Appl. No.: 329,188

[22] Filed: Mar. 27, 1989

[51] Int. Cl.[5] ..... A41D 13/00

[52] U.S. Cl. ..... 223/37; 2/114; 2/DIG. 7

[58] Field of Search ..... 223/37; 2/DIG. 7

[56] References Cited

U.S. PATENT DOCUMENTS

| | | | |
|---|---|---|---|
| 3,045,815 | 7/1962 | Abildgaard | 2/DIG. 7 |
| 3,429,433 | 2/1969 | Holt | 2/DIG. 7 |
| 3,721,999 | 3/1973 | Goya et al. | 2/DIG. 7 |
| 4,000,521 | 1/1977 | Zoephel et al. | 2/114 |
| 4,214,320 | 7/1980 | Belkin | 2/DIG. 7 |
| 4,523,335 | 6/1985 | Scrivens | 223/37 |

*Primary Examiner*—Werner H. Schroeder
*Assistant Examiner*—Bibhu Mohanty
*Attorney, Agent, or Firm*—Singer & Singer

[57] ABSTRACT

A method for folding, sterilizing and using a garment of the type used in a lamina flow clean room without contaminating the sterile outside garment structure. The garment is folded in a preferred manner that places the garment more or less in a half inside out condition and the sleeves are each half folded inside out before the garment is packaged and sterilized. After the package is sterilized the user of the garment unfolds the garment back to the inside out condition and inserts each hand into a folded sleeve. This allows the user to raise the half folded garment over his head and allow the folded garment to unfold without contaminating the outside portion.

3 Claims, 4 Drawing Sheets

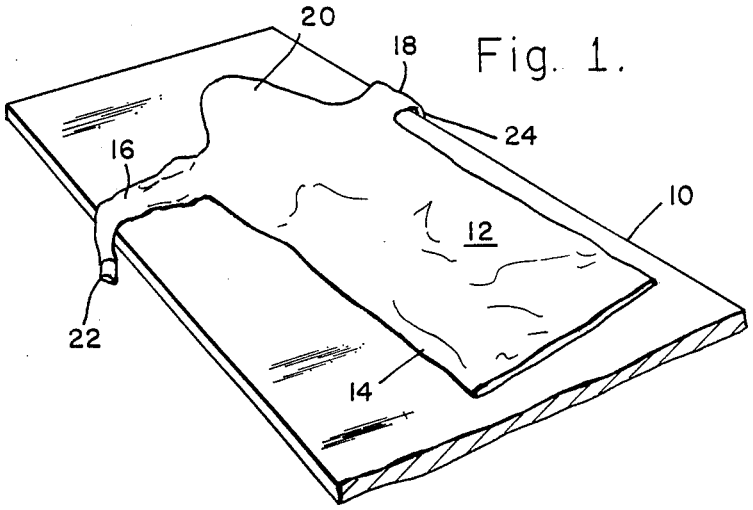
Fig. 1.
Fig. 2.
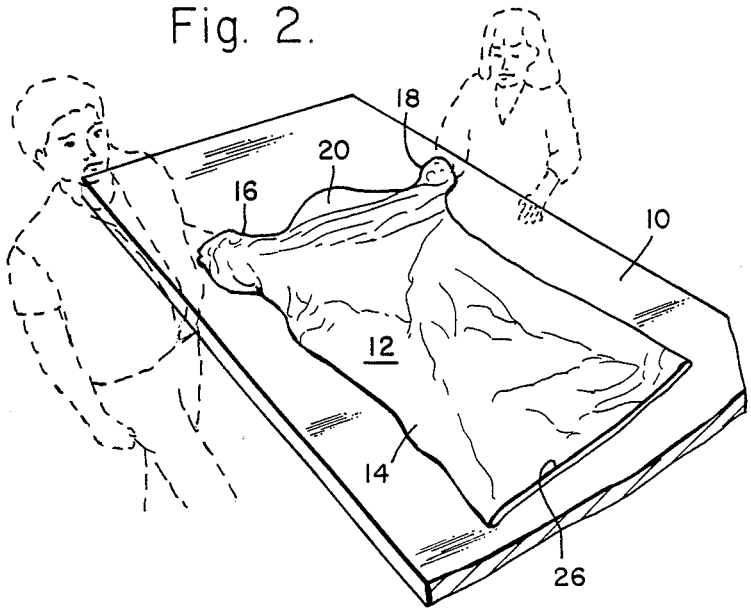
Fig. 3.
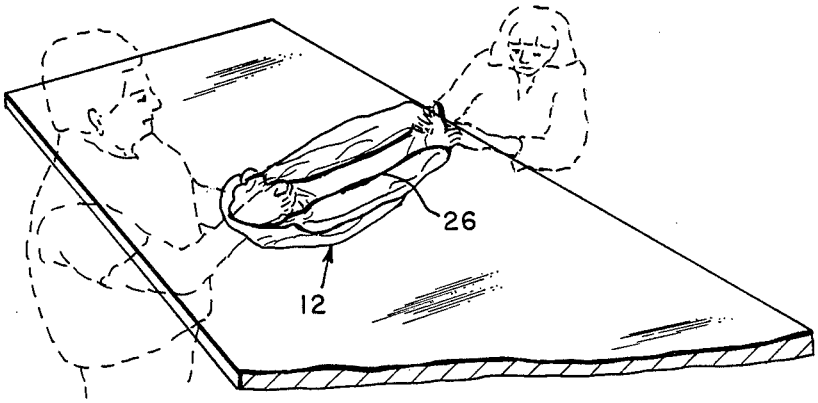

METHOD OF FOLDING STERILE SURGICAL GARMENTS BEFORE AND AFTER STERILIZATION

This invention relates generally to a sterile surgical garment used in lamina flow clean rooms by doctors and nurses and more particularly to a method of folding the garment prior to sterilization and the method of utilizing the sterilized garment without contaminating the outside surface of the garment by the user In the medical field, it is most important to protect the patient in the operating room from infection during high risk procedures from bacteria and other microorganisms that may be brought in on the garments of the doctor and other operating room personnel. To alleviate this, all personnel in the operating room environment are required to be completely covered by a suitable surical gown that has been previously sterilized.

The sterilized gowns are necessary, not only to protect the patient, but also to protect the doctor and operating room personnel from exposure to viruses and other microorganisms from an infected patient.

BACKGROUND OF THE INVENTION

Unfortunately, there are many problems associated with placing a sterile gown on the user. It is most important, of course, that the sterile gown not be contaminated during the process of being opened and placed on the user, and, until the advent of the present invention, it has been very difficult to insure this sterilization of the gown when placed on the user.

The most common prior art technique was to place a sterilized gown over a tent-like apparatus that was hoisted over the user's head. The user would then be placed underneath the apparatus and the sterilized garment would be lowered over the head of the user and in this way the outside surface of the sterilized garment would not be contaminated.

Such devices were, of course, very cumbersome and difficult to use in the environment of a hospital operating room, and as a result, the problem has continued through the present time. In the present invention, the garment is first folded in a half inside out condition and each sleeve is half folded inside out and within the folded garment. The sleeve openings are placed facing the bottom the garment which is then folded, packaged and sterilized.

In the preferred environment, the garment is first folded prior to sterilization and then packaged and ethylene oxide gas sterilized prior to use. After the garment is completely sterilized, the sterile package is then moved conveniently to the operating room where it is opened and the garment placed on a flat table and opened. The user inserts his hands into each folded half sleeve and raises the garment over his head and with a minimum of assistance is able to allow the folded garment to unfold over his body thereby not contaminating the outside surface.

SUMMARY

It is therefore an object of the present invention to provide a garment folded in a preferred manner that allows the user to easily place the folded garment over his body.

It is a further object of the invention to fold the garment prior to sterilization and to fold the garment in such a manner that when unfolded and used, the outside surface is not contaminated by the act of inserting the garment on the user.

A still further object of the invention allows the user to place the garment on his body and without the use of external devices or contrivances.

In the practice of the present invention there is provided a surgical gown having a hood portion and sleeve portions and in which the gown is preferably disposable. In the art as practiced today, disposable materials are preferred because of infection problems generated by the AIDS virus and the fear that AIDS viruses are not easily disposed of or controlled. The doctors therefore prefer a disposable garment that is destroyed after use rather than one that is reprocessed. Be it as it may, the disclosed method of folding and using is applicable to any kind of surgical garment.

The garment is folded prior to sterilization and preferably is placed on a flat surface with the obverse side exposed to the outside. The garment is stretched out so that the sleeve portions are pulled out from the body of the gown and the head portion is pulled out thereby exposing the complete gown on the flat surface.

The cuff portions of each sleeve are grabbed and pulled back to the shoulder portion of the garment, thereby in effect folding each sleeve in half in an inside out condition with the reverse side exposed.

The hem is then gathered and pulled up and over to the shoulder portion of the gown thereby covering the folded sleeves and exposing the reverse side of one half of the gown. In this condition, the gown is half folded. The gown in the inside condition is folded in the form of a square with the folded sleeves on the inside.

The opened end of each sleeve is formed within the folded gown and is located along the bottom edge of the square formed when the hem is folded up to the shoulder portion thereby placing the opened end of the folded sleeve facing the bottom of the gown and opposite the head portion.

The bottom of the gown is opened thereby exposing the folded sleeves. A pull tab is placed on each sleeve portion approximately two inches from the end of the opening in the sleeve. The opened end of each sleeve is repositioned to again place the open edge along the bottom of the gown that is opposite the head portion. The gown is then folded in the form of a square in which the main portion of the gown is inside out and the folded sleeve portions are within the folds of the gown. A second pull tab is attached to the outside portion of the square between each sleeve portion and approximately four inches from the bottom of the square. The square is again folded into a smaller square and completely wrapped and covered. The covered square is placed in a sealed plastic container and the complete package is then sterilized.

Once the gown has been folded and sterilized, it is now an easy matter for the user to move the gown to any location without affecting or contaminating the gown surface.

Prior to use the sterilized container is opened on a substantially flat table and the wrappings around the gown are removed and the gown opened in the form of a square. The bottommost portion of the gown is separated to expose the opened end portions of the folded sleeve portions. The user then inserts a hand into each folded sleeve portion up to the cuff portion, and with each hand inserted within the folded sleeve, the user raises the folded gown over his head. An assistant then pulls on each of the two tabs, one on each of the folded sleeve portions thereby allowing the folded sleeves to unfold and cover the arms of the user.

In this position, the gown is substantially over the head of the user and the sleeves fully cover the arms of the user. An assistant then pulls on the single tab which is located on the reverse side thereby unfolding the gown and which forces the head of the user into the head portion of the gown. The hem portion is pulled down and unfolded thereby placing the user wholly within the gown and without contaminating the outside of the gown.

These and other features and advantages of the present invention will become more apparent by referring now to the accompanying drawings wherein:

BRIEF DESCRIPTION OF THE DRAWINGS

FIG. 1 illustrates the gown located on a table prior to folding;

FIG. 2 illustrates the operators inserting their hands through the cuff in folding each sleeve back to the shoulder portion;

FIG. 3 illustrates the operators gathering the gown prior to folding the hem back to the shoulder portion

DESCRIPTION OF THE PREFERRED EMBODIMENTS

Figure 4:
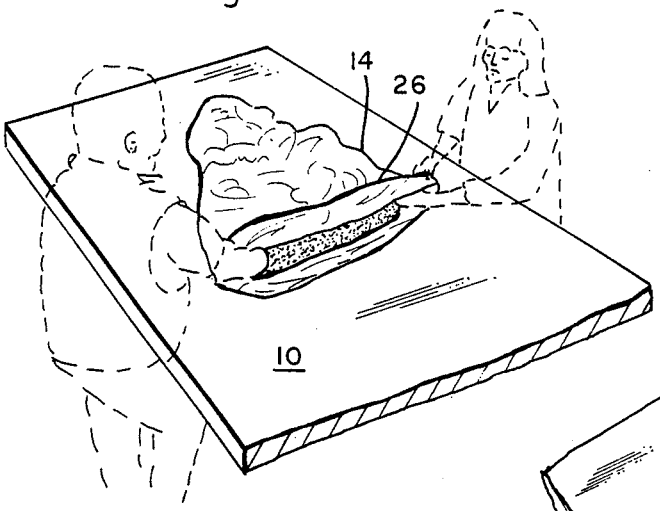
FIG. 4 shows the operators pulling the hem portion back to the shoulder prior to making the garment into a square.

Referring now to FIGS. 1 and 2, there is shown a substantially flat table 10 and a complete single gown 12 comprising a lower body portion 14 and two sleeve portions 16 and 18 together with a head portion 20. The complete gown is laid flat on the table 10 prior to being folded in accordance with the terms of the present invention.

In the preferred environment, two separate operators are used to fold the gown, however, two operators are not needed since a single person could fold the gown as described. It is preferred however to use two operators since the gown can be folded faster and more efficiently as would be required in a commercial operation. Each of the operators inserts her hand within the sleeve portion 16 and 18 and grabs the cuff portion 22 located at the end of sleeve 16 and a cuff portion 24 located at the end of sleeve 18. Cuff portions 22 and 24 are folded back to the shoulder portion of the gown thereby reducing the length of sleeve 16 and 18 to one half of what they normally would be.

Referring now to FIG. 3, the operators are shown gathering the body of the gown 14 preparatory to folding the hem portion 26 back across and to the shoulder portion of the gown 12.

Referring now to FIG. 4, there is shown and illustrated the fact of each operator pulling the hem portion 26 back and up to the shoulder portion of the gown thereby placing the gown in an inside out condition and exposing the reverse side of the body portion of the gown 14.

Figure 5:
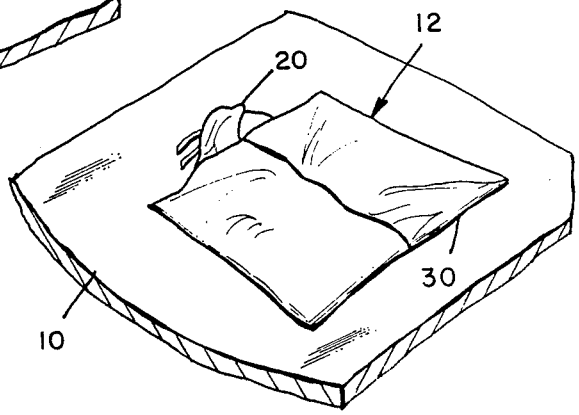
FIG. 5 illustrates the garment folded in a square with the head portion still exposed.

FIG. 5 illustrates the gown 12 formed as a square with the head portion 20 at one end and with the openings of the folded sleeve portions 16 and 18 located within the gown 12 and having the opened end portion along edge 30 which is opposite the head portion 20.

Figure 6:
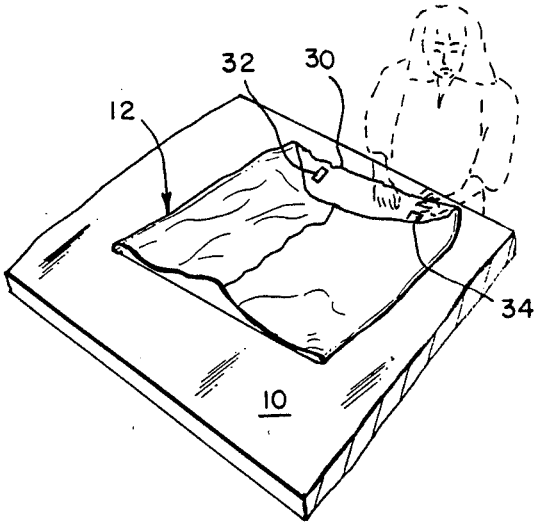
FIG. 6 illustrates the operator separating the bottom portion of the garment and adjusting the folded sleeves on an edge opposite the head and then inserting a tab on each folded sleeve.

Referring now to FIG. 6, there is illustrated an operator placing a tab 32 on the folded sleeve 18 and a tab 34 on the folded sleeve 16. Each of the tabs 32 and 34 are placed approximately two inches from the edge of the gown 30 and will be used by an assistant when the user is inserting the gown on his body.

Figure 7:
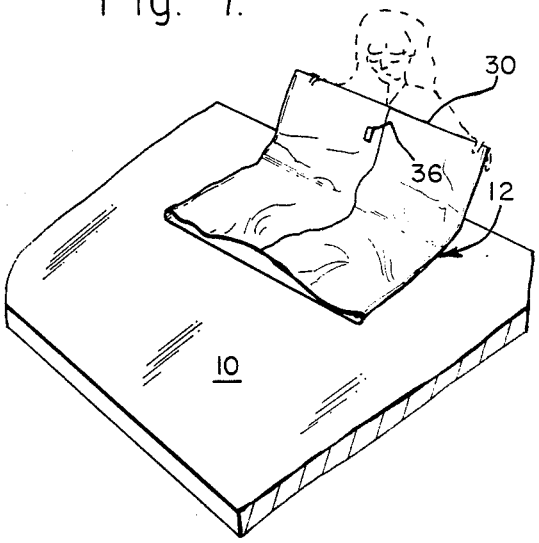
FIG. 7 illustrates the placing of a tab on the outside of the folded garment and on the same side as the folded sleeves.

Referring now to FIG. 7, there is illustrated an operator having placed a single tab 36 on the outside of gown 12 and approximately four inches from the edge 30. The operator is shown folding the gown 12 into a more compact arrangement.

Figure 8:
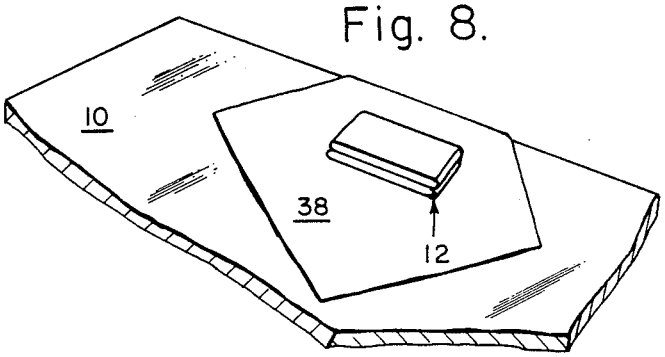
FIG. 8 illustrates a separate inner cover used to wrap around the folded garment prior to being inserted within the plastic container for sterilization.

FIG. 8 illustrates the folded gown 12 placed on a separate covering 38 that will be folded over and protect the gown 12. The complete covering of 38 and the gown 12 is then placed in a plastic bag and the complete unit is sterilized according to well known techniques.

Figure 9:
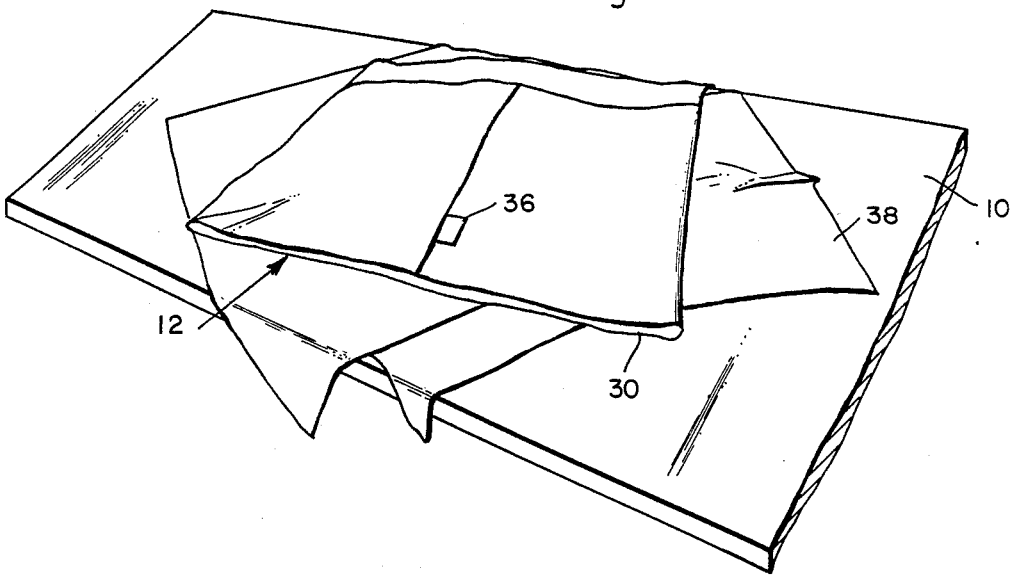
FIG. 9 shows the sterilized gown open in the form of a square and placed on the flat table.

Referring now to FIG. 9, there is shown the gown 12 having been removed from its sterilized plastic container. The outer garment 36 is laid flat on the table 10 with the gown 12 opened in the form of a square. The Tab 36 is shown on the outside close to the edge 30.

Figure 10:
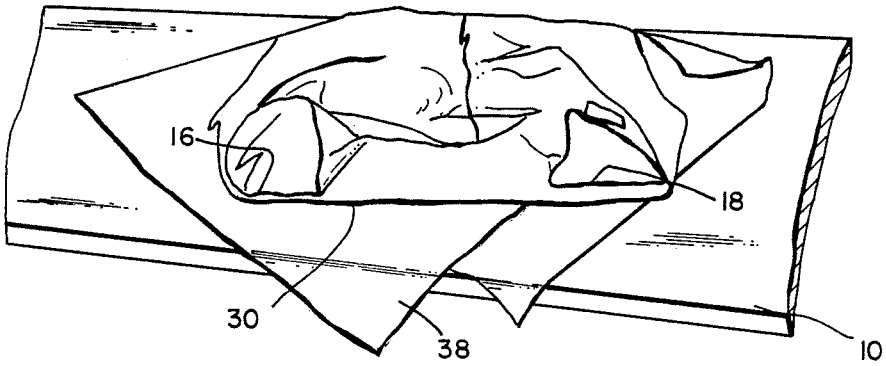
FIG. 10 shows the folded arm portions being exposed from within the bottom portion of the folded gown.

Referring now to FIG. 10, there is shown how the hem portion of the edge 30 is separated to expose the folded sleeve 16 and 18. This step is necessary and preparatory to the user inserting his hands into the folded sleeves 16 and 18. The hands of the user are inserted up to the cuff portion 22 on sleeves 16 and 24 on sleeve 18 as illustrated in FIG. 11.

Figure 11:
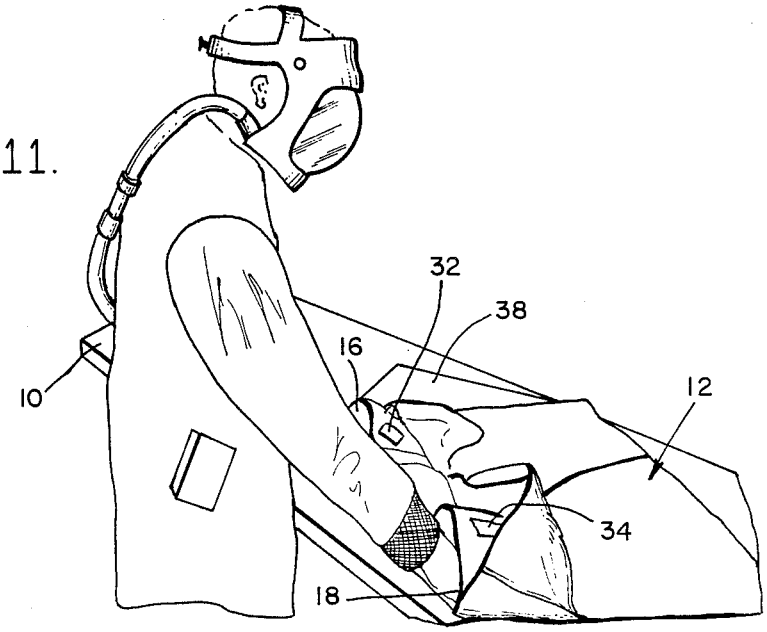
FIG. 11 illustrates the user placing his hands within each of the folded sleeve portions prior to placing the gown on his body.

Referring now to FIG. 11, there is illustrated how the user is inserting his hands within the folded sleeve 16 and 18 respectively while the gown 12 is still located on the table 10.

Figure 12:
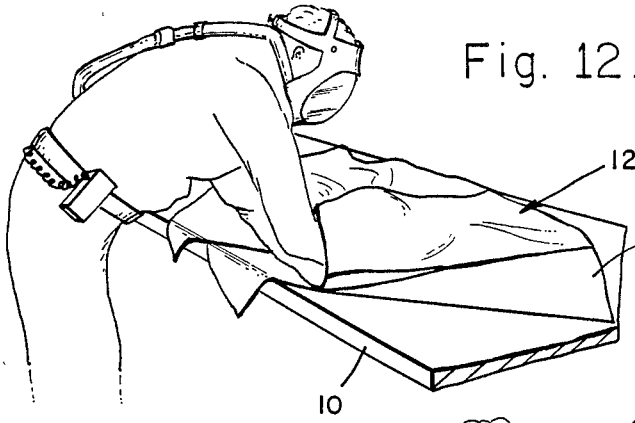
FIG. 12 illustrates the user extending his hands to the cuff portion of each folded sleeve prior to placing the gown over his head together with an assistant pulling the tabs on each folded sleeve portion.

Referring now to FIG. 12, there is shown how the user is bending forward and moving each of his arms into sleeves 16 and 18 and in such a manner that each of his hands grabs the cuff portion 22 and 24 associated with sleeves 16 and 18 respectively.

Figure 13:
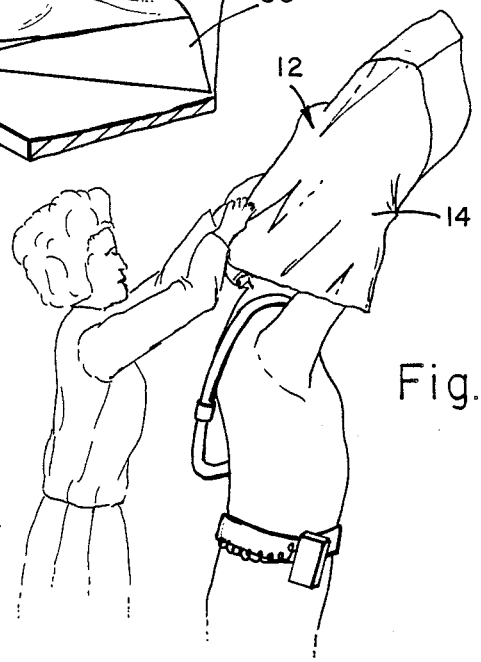
FIG. 13 illustrates the user with the gown over his head and the assistant pulling the single tab on the outside causing the gown to be pulled down over the body of the user.

FIG. 13 illustrates how the user, while holding the cuff portion 22 and 24 in each hand, lifts the gown 12 above his head while an associate grabs each of the tabs 32 and 34 located on the folded sleeve 16 and 18. While the associate pulls on the tabs 32 and 34, this helps the user push his hands up and into the sleeves 16 and 18 and allows the sleeves to unfold thereby covering each arm as the garment is pulled down.

Figure 14:
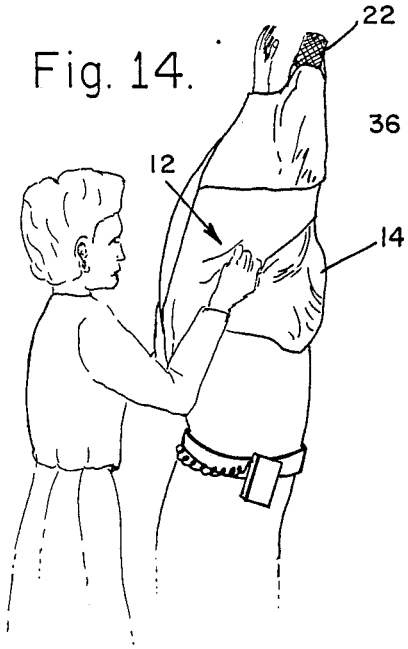
FIG. 14 illustrates the user with the gown over his head with the folded gown being unfolded and the users head being covered by the gown.
Figure 15:
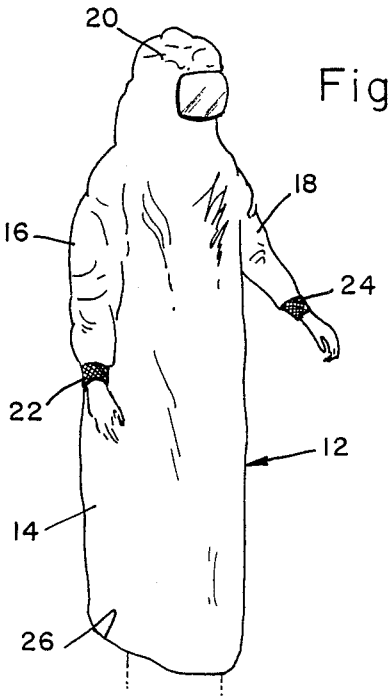
FIG. 15 illustrates the gown completely covering the user's head and body and arms.

Referring now to FIG. 14, there is shown how an associate now grabs the single tab 36 on the body portion 14 of gown 12 and by pulling down on the tab 36 the head portion of the gown is forced to cover the head of the user and the body portion of the gown is folded down over the body of the user as is now shown in FIG. 15.

As shown in FIG. 15 the gown is unfolded and can now be assembled on the user and without the use of external equipment and at the same time without compromising the sterility of the outside of the gown.

I claim:

1. A method of folding a surgical gown into a complete package having a hood portion, sleeve portions cuff portion, hem portions, head portion, and an open end comprising the steps of:

placing the gown on a flat surface with the obverse side exposed;

extending the hood portion and the sleeve portions out from the body of the gown so the garment is flat;

pulling the cuff portion of each sleeve up to the shoulder portion thereby folding each sleeve in half and inside out;

gathering the hem portion and folding the gown in half by bringing the hem portion to the shoulder portion thereby leaving half the gown folded inside out with the head portion exposed and the gown substantially flat and in the form of a square;

separating the bottommost portion of the gown and folding the open end of each half sleeve within the folded gown and locating the open end along the edge of the square opposite the head portion;

attaching a pull tab on each sleeve portion within the square and approximately 2 inches from the end of the opening in the sleeve;

folding the head portion within the square;

attaching a single pull tab to the outside portion of the square between each sleeve portions and approximately 4 inches from the bottom of the square;

folding and completely wrapping the gown and inserting the wrapped gown into a sealed plastic container; and then sterilizing the complete package.

2. The method of using the sterilized package defined in claim 1 in which the gown has folded sleeve positions and the sealed plastic container is the wrapping covering the sterilized gown comprising the steps of:

opening the sterilized packaged on a substantially flat table, removing the wrapping and opening the folded package into the form of a square;

opening the bottommost portion of the gown to expose the folded sleeve portions, inserting a hand into each folded sleeve portion up to the cuff and raising the folded gown over the head of the user;

pulling on each of the two tabs on the folded sleeve portion thereby allowing the folded sleeves to unfold and cover the arms of the user;

pulling on the single tab thereby unfolding the gown and forcing the head of user into the head portion of the gown; and then unfolding the hem portion of the gown thereby placing the user wholly within the gown without contaminating the outside of the gown.

3. A method of folding a surgical gown into a complete package having a hood portion, sleeve portion, folded sleeve, cuff portion, hem portion, an open end and in which the sealed plastic container is the wrapping covering the sterilized gown and without contaminating the outside surface comprising the steps of:

placing the gown on a flat surface with the obverse side exposed;

extending the hood portion and the sleeve portions out from the body of the gown so the garment is flat;

pulling the cuff portion of each sleeve up to the shoulder portion thereby folding each sleeve in half and inside out;

gathering the hem portion and folding the gown in half by bringing the hem portion to the shoulder portion thereby leaving half the gown folded inside out with the head portion exposed and the gown substantially flat and in the form of a square;

separating the bottommost portion of the gown and folding the open end of each half sleeve within the folded gown and locating the open end along the edge of the square opposite the head portion;

attaching a pull tab on each sleeve portion within the square and approximately 2 inches from the end of the opening in the sleeve;

folding the head portion within the square;

attaching a single pull tab to the outside portion of the square between each sleeve portions and approximately 4 inches from the bottom of the square;

folding and completely wrapping the gown and inserting the wrapped gown into a sealed plastic container;

then sterilizing the complete package;

opening the sterilized packaged on a substantially flat table, removing the wrapping and opening the folded package into the form of a square;

opening the bottommost portion of the gown to expose the folded sleeve portions, inserting a hand into each folded sleeve portion up to the cuff and raising the folded gown over the head of the user;

pulling on each of the two tabs on the folded sleeve portion thereby allowing the folded sleeves to unfold and cover the arms of the user;

pulling on the single tab attached to the square between each sleeve portion thereby unfolding the gown and forcing the head of user into the head portion of the gown; and then unfolding the hem portion of the gown thereby placing the user wholly within the gown without contaminating the outside of the gown.

* * * * *